US007347663B2

(12) United States Patent
Nakahama et al.

(10) Patent No.: US 7,347,663 B2
(45) Date of Patent: Mar. 25, 2008

(54) ABRASION RESISTANT SURFACE TREATMENT METHOD OF A ROTARY MEMBER, RUNNER, AND FLUID MACHINE HAVING RUNNER

(75) Inventors: Shuhei Nakahama, deceased, late of Kisarazu (JP); by Kazuko Nakahama, legal representative, Kisarazu (JP); Toru Ishido, Kamakura (JP); Masaru Takahashi, Yokohama (JP); Yasuo Asano, Tokyo (JP); Hiroshi Nagasaka, Yokohama (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/512,562

(22) PCT Filed: Apr. 24, 2003

(86) PCT No.: PCT/JP03/05272

§ 371 (c)(1),
(2), (4) Date: Jan. 23, 2006

(87) PCT Pub. No.: WO03/093525

PCT Pub. Date: Nov. 13, 2003

(65) Prior Publication Data

US 2006/0127223 A1 Jun. 15, 2006

(30) Foreign Application Priority Data

Apr. 30, 2002 (JP) ..... 2002-128016

(51) Int. Cl.
*F04D 29/22* (2006.01)
*C23C 4/12* (2006.01)

(52) U.S. Cl. ..... 415/200; 416/241 R; 427/376.6; 427/448

(58) Field of Classification Search ..... 416/186 R, 416/241 R; 427/376.1, 376.4, 376.6, 376.7, 427/376.8, 446, 448, 449, 451, 456
See application file for complete search history.

(56) References Cited

U.S. PATENT DOCUMENTS

| | | | | |
|---|---|---|---|---|
| 4,817,856 | A * | 4/1989 | Koistinen et al. | 228/176 |
| 5,601,411 | A * | 2/1997 | Usami et al. | 416/241 R |
| 5,855,963 | A * | 1/1999 | Urbanek et al. | 427/448 |
| 5,938,403 | A * | 8/1999 | Okada et al. | 415/200 |

FOREIGN PATENT DOCUMENTS

| | | |
|---|---|---|
| JP | 6-323298 | 11/1994 |
| JP | 9-41117 | 2/1997 |
| JP | 2001-107833 | 4/2001 |

* cited by examiner

*Primary Examiner*—Edward K. Look
*Assistant Examiner*—Nathan Wiehe
(74) *Attorney, Agent, or Firm*—Westerman, Hattori, Daniels & Adrian, LLP.

(57) ABSTRACT

The invention provides a method for performing abrasion resistant surface treatment on a surface of a rotary member. The abrasion resistant surface treatment method is characterized by including steps of: dividing the surface of the rotary member into a plurality of areas $A_1$, $A_2$ depending on peripheral speed or treatment difficulty in surface treatment of the rotary member 1; spraying an abrasion resistant material on a surface of a first area where the peripheral speed is the highest, or the treatment difficulty is low, by a high speed flame spraying method; and spraying an abrasion resistant material on a surface of the second area with high treatment difficulty, by an arc spraying method.

9 Claims, 4 Drawing Sheets

TABLE 1 *Figure 3*

| PROPERTY ITEM / SPRAYING METHOD | HEAT SOURCE | SPRAY MATERIAL | | ADHESION ($Kg/cm^2$) | POROSITY (%) | AMOUNT OF DEPOSITION (kg/h) | APPROPRIATE THICKNESS (mm) | REMARKS |
|---|---|---|---|---|---|---|---|---|
| | | TYPE | SHAPE | | | | | |
| GAS WIRE METHOD | OXYGEN/ ACETYLENE OXYGEN/ PROPANE | GENERAL METAL MATERIAL | WIRE | 150-200 | 10-20 | 3 | 0.3-1.0 | APPLICABLE TO CARBIDE CERAMIC BY APPLYING COMPOSITE WIRE |
| GAS POWDER METHOD | OXYGEN/ACETYLENE OXYGEN/PROPANE OXYGEN/HYDROGEN | GENERAL METAL MATERIAL AND PLASTIC MATERIAL | POWDER | 120-200 | 10-20 | 1 | 0.2-1.0 | APPLICABLE TO PLASTIC MATERIAL |
| ARC METHOD | ARC | GENERAL METAL MATERIAL | WIRE | 200-300 | 5-15 | 20-30 | 0.1-3.0 | APPLICABLE TO CARBIDE CERAMIC BY APPLYING COMPOSITE WIRE |
| GAS PLASMA METHOD | PLASMA FLAME OF ARGON/ HYDROGEN NITROGEN/ HYDROGEN ARGON/HELIUM, ETC. | GENERAL METAL MATERIAL AND CERAMIC MATERIAL | POWDER | METAL: 500-800 CERAMIC: 300-400 | 3-15 | METAL: 5-25 CERAMIC: 5-8 | 0.05-0.5 | APPLICABLE TO HIGH MELTING POINT |
| DECOMPRESSION PLASMA METHOD | | MAINLY CERAMIC MATERIAL | POWDER | THERE IS A REPORT OF 4000 OR MORE. | 0.5-5 | CERAMIC: 5-20 | 0.05 OR MORE | EXPENSIVE |
| HVOF SYSTEM | OXYGEN/ ACETYLENE OXYGEN/ PROPANE | GENERAL METAL MATERIAL AND CARBIDE CERAMIC MATERIAL | POWDER | METAL: 700-900 CERAMIC: 300-500 | 0.5-3 | METAL: 3-5 CERAMIC: 1-2 | 0.05-0.5 | NOT APPLICABLE TO CERAMIC WITH HIGH MELTING POINT |
| HP/HVOF SYSTEM | OXYGEN/ KEROSENE | GENERAL METAL MATERIAL AND CARBIDE CERAMIC MATERIAL | POWDER | METAL: 800-1000 CERAMIC: 400-600 | 1.0 OR LESS | METAL: 5-20 CERAMIC: 3-10 | 0.05-1.0 | NOT APPLICABLE TO CERAMIC WITH HIGH MELTING POINT |
| SPRAYING AND FUSING METHOD | OXYGEN/ ACETYLENE OXYGEN/ HYDROGEN | SELF-FLUXING ALLOY MATERIAL | POWDER OR WIRE | 3500 OR MORE. | 0 | 1.3 | 0.5-2.0 | HEAT DISTORTION CAUSES DEFORMATION |

ABRASION RESISTANT SURFACE TREATMENT METHOD OF A ROTARY MEMBER, RUNNER, AND FLUID MACHINE HAVING RUNNER

TECHNICAL FIELD

The present invention relates to an abrasion resistant surface treatment method, a rotary member treated by the treatment method, and a fluid machine including the rotary member, and more particularly to a surface treatment method in which an area to be treated is divided into a plurality of areas in view of a peripheral speed of a rotary member and treatment difficulty in abrasion resistant surface treatment, and wherein an abrasion resistant material is deposited on a surface of the rotary member by a treatment method appropriate for each area, a runner as a rotary member having surfaces treated by the method, and a fluid machine including the runner.

BACKGROUND ART

A rotary member, such as a runner used in a turbine or a pump may suffer surface abrasion caused by some fluids used during operation. When a clean liquid, that is, a liquid containing few particulates is used, surface abrasion of a runner is not a significant problem except for surface abrasion caused by cavitation. However, for a runner of a hydraulic machine such as a turbine or a pump which handles water containing a large amount of sand and soil, a surface of the runner is washed out by fine particles of the sand and soil in the water, and suffers abrasion at an early stage.

A runner that is used in a hydraulic machine such as a turbine used in a power plant built in a river containing a large amount of sand and soil, especially quartz components, suffers extreme abrasion, and becomes unusable at an early stage. Thus, a rotary member such as a runner used under such an environment has been surface treated with an abrasion resistant material, but a conventional method cannot provide sufficient abrasion resistance.

Depending on types of turbines or pumps to be used, some runners have vanes of a complex shape, and surface treatment by depositing an abrasion resistant material is sometimes extremely difficult depending on spots to be treated. For example, a Francis turbine runner has a complexly curved vane, and the vane is placed between two members, that is, a main plate (a hub or a crown) and a side plate (a shroud or a band), thus surface treatment of an inside of the runner is extremely difficult.

On the other hand, various methods for surface treatment by depositing an abrasion resistant material on a surface have been known. For example, the methods include a gas powder method, an arc spraying method, a gas plasma method, a high speed flame spraying method, a spraying and melting method, or the like. The inventor studied whether these methods can be applied to abrasion resistant surface treatment of a runner, and found that sprayable materials are limited by differences in heat sources, or the like. This causes differences in abrasion resistance of treated surfaces, and further limits locations where the surface treatment can be performed depending on spraying methods.

DISCLOSURE OF THE INVENTION

The invention is achieved in order to solve the above described problems. An object of the present invention is to provide a treatment method in which, for example, a surface treatment method of a rotary member such as a runner of a fluid machine is selected in view of treatment difficulty, a peripheral speed, or the like to perform surface treatment by the optimum method.

Another object of the invention is to provide an abrasion resistant surface treatment method in which surface treatment is performed on an area that meets a condition of either low treatment difficulty or high peripheral speed by a high speed flame spraying method; surface treatment is performed on an area with high treatment difficulty by a spraying and melting method or an arc spraying method, or a combination thereof, thus providing high abrasion resistance and high crack resistance.

A further object of the invention is to provide an abrasion resistant surface treatment method in which a further treatment method is applied to an area between the area in which a surface treatment by the high speed flame spraying method is performed and an area in which a surface treatment by the spraying and melting method is performed, thus further increasing the abrasion resistance and the crack resistance.

A further object of the invention is to provide a runner as a rotary member that is surface treated by the above described treatment methods, and a fluid machine including the runner.

The invention provides a method for performing abrasion resistant surface treatment on a surface of a rotary member, including steps of: dividing the surface of the rotary member into a plurality of areas depending on peripheral speed or treatment difficulty in surface treatment of the rotary member; spraying an abrasion resistant material on a surface of a first area where the peripheral speed is the highest, or the treatment difficulty is low, by a high speed flame spraying method; and spraying an abrasion resistant material on a surface of the second area with high treatment difficulty, by an arc spraying method or a spraying and melting method.

The abrasion resistant surface treatment method may further include steps of: providing a third area with intermediate treatment difficulty between the first area and the second area of the rotary member; and spraying an abrasion resistant material on the second area by the spraying and melting method, and on the third area by the arc spraying method.

In the abrasion resistant surface treatment method, the rotary member may be a runner including a main plate, a side plate spaced from the main plate axially of the rotary member and a plurality of vanes circumferentially spaced between said main plate and said side plate, said main plate, side plate and vanes defining passages, and said first area may include a respective part of surfaces of said main plate, said side plate and said vanes defining said passages and is located at a position within a desired distance radially inward from an outer diameter of said runner. In this case, an abrasion resistant material may be deposited on an outer surface of the side plate by the high speed flame spraying method, or instead or in addition, the side plate may define a radially inward opening which is defined by a circle with a desired radius around an axis of the runner, and the area which is to be surface treated by the spraying and melting method or the arc spraying method may be the vane surface facing the radially inward opening.

The invention provides a runner including: a main plate and a side plate that are axially spaced and radially extend; and a plurality of vanes which are circumferentially spaced between the main plate and the side plate, and integral with the main plate and the side plate; the main plate, the side plate and the vanes defining a fluid passage; an abrasion resistant material being deposited on surfaces of the main plate, the side plate and the vanes that define the passage by high speed flame spraying, in a first area at a desired distance radially inward from an outer periphery of the runner, and an abrasion resistant material being deposited on the surfaces of the main plate, the side plate and the vanes which define the passage by an arc spraying method or a spraying and melting method, in a second area between an inner periphery and the first area.

In the runner, an abrasion resistant material may be deposited on the surfaces of the main plate, the side plate and the vanes by the arc spraying method; in a third area between the first area and the second area of the passage of the runner, an abrasion resistant material may be deposited on the second area by the spraying and melting method, and an abrasion resistant material may be deposited on an outer surface of the side plate by the high speed flame spraying method.

In the runner, the side plate may define a radially inward opening which is defined by a circle with a desired radius around an axis of the runner, and an abrasion resistant material may be deposited on the vane surface facing the radially inward opening by the spraying and melting method.

The invention further provides a fluid machine including the runner.

BRIEF DESCRIPTION OF THE DRAWINGS

FIG. 3 is a table illustrating various spraying methods;

BEST MODE FOR CARRYING OUT THE INVENTION

Now, an abrasion resistant surface treatment method according to the invention will be described with reference to the drawings, taking surface treatment of a runner of a pump as an example.

Figure 1:
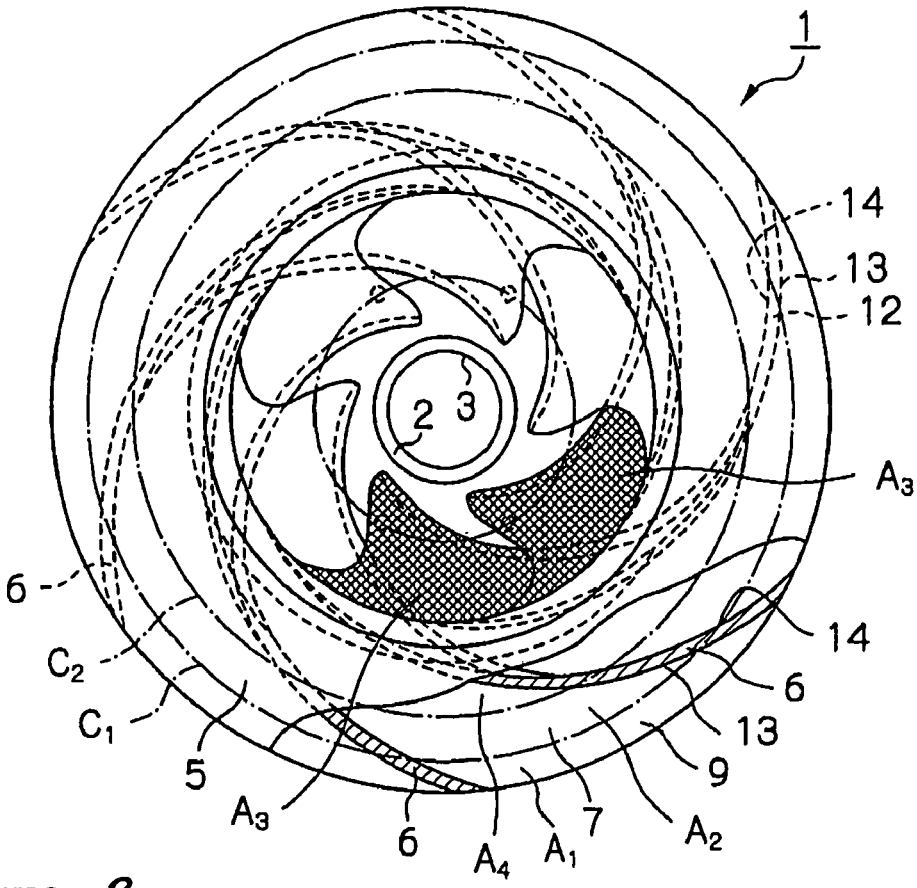
FIG. 1 is a plan view of a runner of a fluid machine that is subjected to abrasion resistant surface treatment according to the invention.
Figure 2:
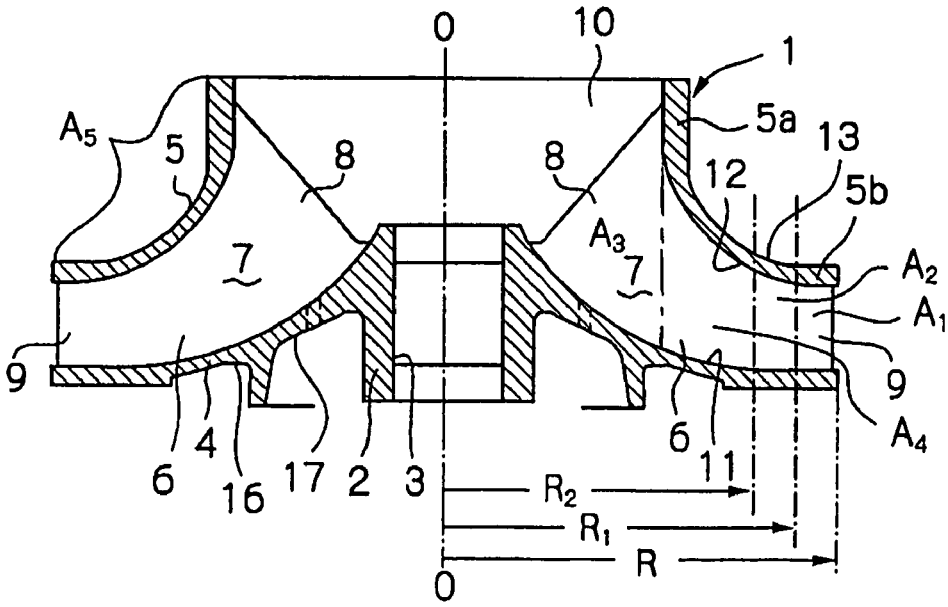
FIG. 2 is a sectional view of the runner in FIG. 1.

FIGS. 1 and 2 show a runner 1 of a pump in which the abrasion resistant surface treatment method is carried out. The runner 1 includes a hub 2 formed with a shaft hole 3 that receives a rotary shaft, a disk-like main plate 4 radially extending outward from the hub 2, an annular side plate 5 axially (vertically in FIG. 2) spaced from the main plate 4, and a plurality of vanes 6 which are circumferentially (circumferentially around an axis O-O in the shaft hole) and uniformly spaced between the main plate 4 and the side plate 5. The vanes are curved along a desired curved surface and integrally formed with the main plate and the side plate. The main plate 4, the side plate 5 and the vanes 6 define passages 7 through which a fluid passes. A radially inner portion 8 of the passage 7 is an inlet portion, and a radially outer portion 9 is an outlet portion. The annular side plate 5 has a portion 5*a* extending axially on the circumferentially inner side, and a portion 5*b* extending radially outward, and defines an inlet 10 of the runner 1 by the axially extending portion 5*a*. When the runner 1 is rotated by a fluid, or the runner 1 is rotated to feed out a fluid, a peripheral speed is naturally higher at the outlet portion than at the inlet portion near the axis O-O in proportion to a distance from the axis. Thus, for example, when the runner is rotated in water containing sand and soil, particles of the sand and soil in the water hit a surface of the runner 1, especially an inner surface 11 of the main plate 4, an inner surface 12 of the side plate 5, both surfaces of the vane 6, that is, a surface 13 on which a positive pressure acts and a surface 14 on which a negative pressure acts, at high speed to rub them, since the peripheral speed is high at the outlet portion 9 on the radially outer side, and therefore, the surfaces suffer extreme abrasion. The inner surface 11 of the main plate 4, the inner surface 12 of the side plate 5, the both surfaces of the vane 6, define the passages 7 in the runner 1.

In terms of performing the abrasion resistant surface treatment, the inner surfaces 11, 12, the surface 13 in positive pressure side, and the surface 14 in a negative pressure side which define the passages have to be treated through the inlet portion 8 or the outlet portion 9 of the runner. However, as is clear from FIG. 1, the vane 6 is complexly curved between the main plate 4 and the side plate 5 from the inlet portion 8 on the radially inner side toward the outlet portion 9 on the radially outer side, and thus treatment in a central area of the passages is extremely difficult. Thus, the abrasion resistant treatment has been rarely performed on the surface of each passage, especially in a central area of each passage where the treatment is difficult.

Figure 4:
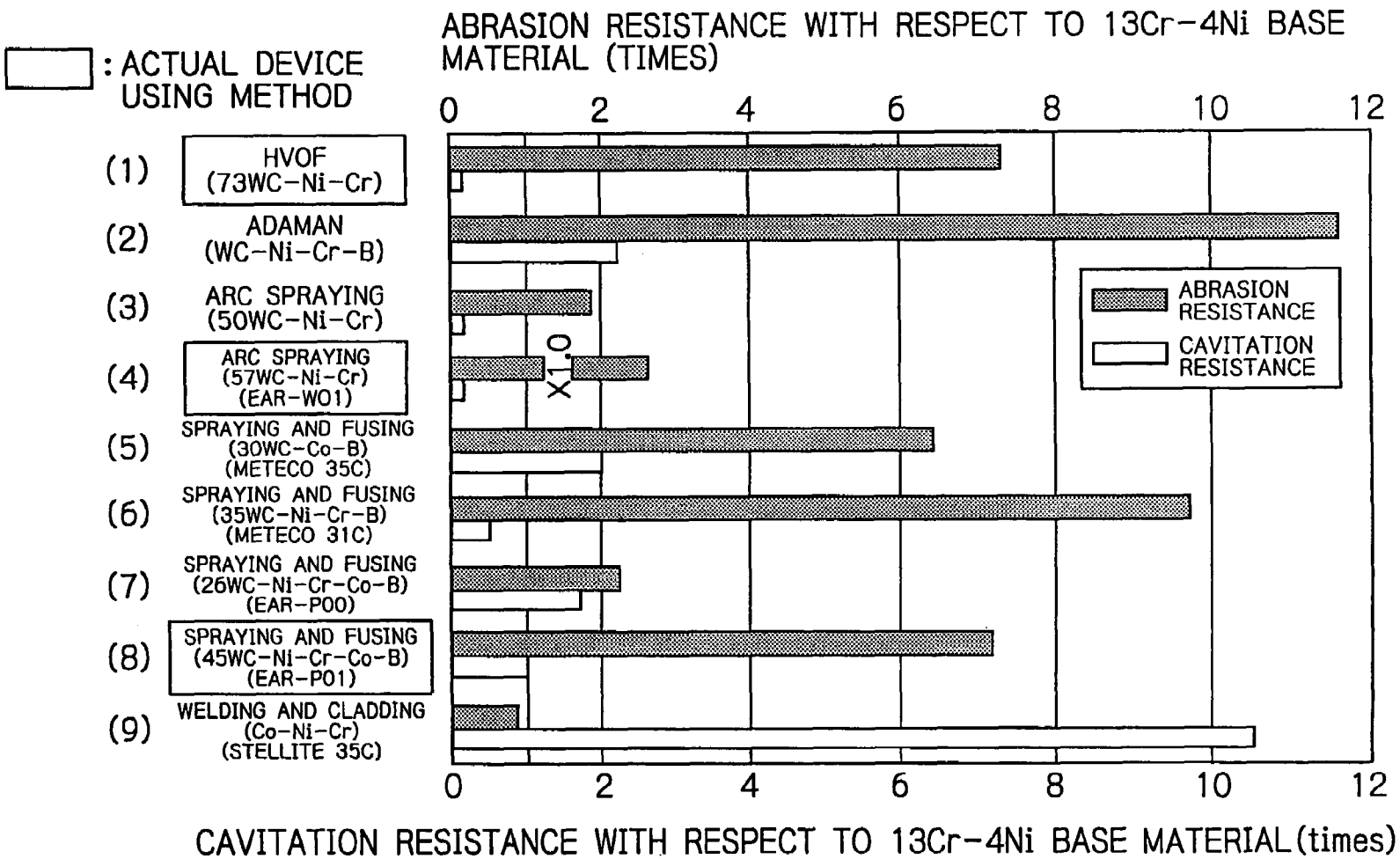
FIG. 4 is a graph of performance of surface treatment layers by the particular spraying methods in FIG. 3.

For applicable methods as the abrasion resistant surface treatment method, Table 1 in FIG. 3 shows currently known methods as a method for depositing an abrasion resistant material on a surface to be treated, depending on differences in heat sources used for deposition, types of spray materials to be deposited, and differences in shapes of the spray materials. In the invention, some methods were selected among these methods as a treatment method of the runner in view of applicability (possibility of treatment on spots where the treatment is difficult), properties of a deposited treatment layer, cost efficiency, or the like, some materials suitable for the treatment methods were selected to perform the abrasion resistant surface treatment, and abrasion resistance and cavitation resistance of the treated surfaces were evaluated. The results are compared and shown in the graph in FIG. 4. The spray material can be selected based on the results. In an ADAMAN method of (1), and spraying and melting of (5) and (6) in the graph in FIG. 4, one or more cracks were found in a deposited abrasion resistant layer during a test, and it was found that the methods are inappropriate as the surface treatment method of the invention. Considering these results, it was decided that an arc spraying method is selected for an area or spot in the center of each passage where the treatment is difficult, with an emphasis on possibility of treatment, and a high speed flame spraying method and a spraying and melting method are selected for an area such as the inlet portion or the outlet portion of the passage where the treatment is easy, with an emphasis on a deposited treatment layer and cost efficiency.

Thus, for the runner in FIGS. 1 and 2, an area to be surface treated of the runner, that is, the surfaces of the passages and the outer surface 13 of the side plate are sectioned into a plurality of areas in view of treatment difficulty of the abrasion resistant surface treatment and the peripheral speed, and the selected treatment methods are applied to the areas. Specifically, in this embodiment, an abrasion resistant surface treatment area of the runner 1 is decided such that an area of the surface of the passages between a radially outer side of a circle $C_1$ with a radius $R_1$ from an axis O-O and an outer periphery (radius R) of the runner 1 is $A_1$ (this area is easily accessible from an outer peripheral side of the runner, thus the treatment difficulty is low but the peripheral speed is high), an area of the passage surface between the circle $C_1$ with the radius $R_1$ and a circle $C_2$ with a smaller radius $R_2$ is $A_2$, an area (a cross-hatched area in FIG. 1) near an edge on an inlet side of a vane at the inlet portion and visible through the radially inward opening forming the inlet 10, and an area of an inner surface of the axially extending portion 5*a* of the side plate 5 are $A_3$, an area of the passage surface other than the areas $A_1$ to $A_3$ (in this area, the passage is curved to be narrow, thus the treatment difficulty is the highest) is $A_4$, and the outer surface 13 of the side plate 5 (this area is easily accessible from the outside, thus the treatment difficulty is the lowest) is $A_5$.

After the abrasion resistant treating surface is sectioned into the above described areas, a desired spray material (in this embodiment, 45WC—Ni—Cr—Co—B) is selected and deposited on the surface 13 belonging to the area $A_2$ and the surfaces 11, 12, 13, 14 belonging to the area $A_3$ by the spraying and melting method. The deposition layer of the spray material is preferably 0.5 mm to 3 mm thick. The spraying and melting method may be the same as the conventional method, thus detailed descriptions thereof will be omitted.

Next, the abrasion resistant material is deposited on the inner surfaces 11, 12, the surface 13 on which a positive pressure acts, and the surface 14 on which a negative pressure acts, in the area $A_4$ by the arc spraying method. In this arc spraying method, it is difficult to access the area from the outside of the runner as described above, thus, for example, a special torch (not shown) is used that has a torch head for spraying a flexible spray material attached to a tip of a long stem and is capable of arc spraying on an inner deep area or spot from the outer periphery of the runner. A desired spray material (in this embodiment, 57WC—Ni—Cr in FIG. 4) is selected as the flexible spray material used by the special spraying torch, and the abrasion resistant material is sprayed on each of the surfaces 11, 12, 13 and 14 of the passage 7 in the area $A_4$ such that the deposition layer of the spray material is, preferably, 0.5 mm to 2 mm thick. Finally, a desired spray material (in this embodiment, 73WC—Ni—Cr) is selected and deposited on the surfaces 11, 12, 13 and 14 belonging to the area $A_1$ and the surface 15 belonging to the area $A_5$ by the high speed flame spraying method (HVOF or the like). The deposition layer of the spray material is preferably 0.5 mm to 2 mm thick. The high speed flame spraying method may be the same as the conventional method, and detailed descriptions thereof will be omitted. The abrasion resistant surface treatment of the runner is thus completed.

In the above described embodiment, the abrasion resistant surface treatment is not performed on back surfaces 16, 17 of the main plate 4 of the runner, but the abrasion resistant surface treatment may be performed on the back surfaces as required.

Figure 5:
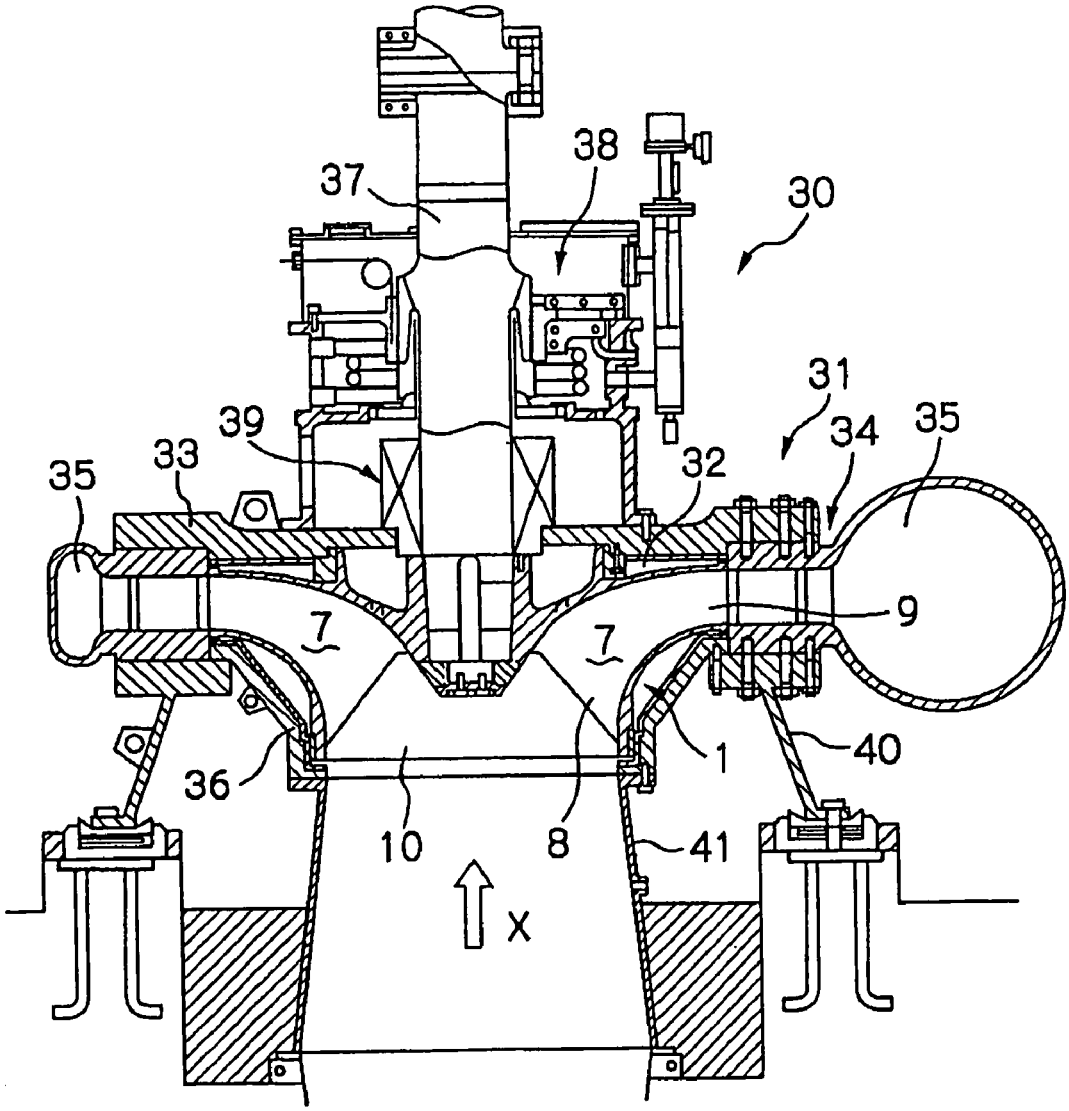
FIG. 5 is a sectional view of an example of a pump as a fluid machine having the runner according to the invention.

The runner 1 according to the invention subjected to the abrasion resistant surface treatment as described above is used in a fluid machine such as a water turbine or a pump. FIG. 5 shows a sectional-view of a vertical pump 30 as an example of the fluid machine. In the figure, the pump 30 includes a casing 31 that defines a pump chamber 32 housing the runner 1 according to the invention, a main shaft 37 that is vertically placed and has a bottom end to which the runner 1 is secured, a main bearing 38 that is attached to an upper portion of the casing and supports the main shaft 37 rotatably with respect to the casing, and a seal device 39 that prevents leakage of a fluid from between the casing 31 and the main shaft 37. The casing 31 is secured on a tubular support 40 by a known method. The casing 31 includes an upper disk-like end plate 33, a casing body 34 defining a spiral outlet chamber 35, and a tubular cover 36. A cylindrical draft tube 41 is connected to a bottom end of the cover 36.

For the above described pump, when the main shaft 37 is rotated to rotate the runner 1 secured to the bottom end of the main shaft 37, a fluid is sucked into the inlet 10 of the runner in the draft tube 41 as shown by an arrow X, radially pushed out of the outlet 9 through the passage 7 of the runner 1, and flows into the outlet chamber 35. The fluid in the outlet chamber is discharged from an outlet not shown.

In the runner that is surface treated by the abrasion resistant surface treatment method according to the invention, all the surfaces that may suffer abrasion are subjected to the abrasion resistant surface treatment, thus providing high abrasion resistance. Therefore, the runner provides high abrasion resistance even when pumping up a liquid containing fine particulates such as sand.

INDUSTRIAL APPLICABILITY

The invention provides the following advantages.

(a) According to the abrasion resistant surface treatment method of the invention, the rotary member is divided into a plurality of areas in view of the peripheral speed or the treatment difficulty in surface treatment to treat the surface of each area by the optimum surface treatment method, thus allowing the surface treatment to be performed on an entire rotary member which has a complex shape and where the treatment is difficult.

(b) The spraying method can be carried out in which a material that is easy to treat and has high abrasion resistance can be deposited on an area where the treatment is easy, and therefore, surface treatment providing higher abrasion resistance can be performed on an area which suffers extreme abrasion.

(c) The rotary member of the invention has high abrasion resistance, thus increasing its life.

Although the present invention has been described above in detail with reference to the drawings, the foregoing description is for explanatory purposes and not intended to limit characteristics. It should be understood that the foregoing description merely illustrates and explains preferred embodiments, and all modifications and changes within the scope of the spirit of the present invention are protected.

The entire disclosure of Japanese Patent Application No. 2002-128016 filed on Apr. 30, 2002 including specification, claims, drawings and summary is incorporated herein by reference in its entirety.

The invention claimed is:

1. A method for performing abrasion resistant surface treatment on surfaces of fluid passages defined by a main plate, a side plate and vanes of a rotary member, comprising steps of:

dividing the surface of the fluid passages into a plurality of areas determined based on radius from an axis of rotation of said rotary member;

spraying an abrasion resistant material on a surface of the fluid passages in a radially outer-most area A1 between an outer periphery of said rotary member and a circle C1 with a desired radius R1, by a high speed flame spraying method; and spraying an abrasion resistant material including WC, Ni, Cr, Co and B on a surface of the fluid passages in a radially inner-most area A3 inside a radially inward opening defined by a circle with a desired radius around an axis of said rotary member, by a spraying and fusing method.

2. The abrasion resistant surface treatment method according to claim 1, further comprising a step of:

spraying an abrasion resistant material including WC, Ni, Cr. Co and B on a surface of the fluid passages in an area A2 between the circle $C_1$ with the radius $R_1$ and a circle $C_2$ with a desired radius $R_2$, by a spraying and fusing method.

3. The abrasion resistant surface treatment method according to claim 2, further comprising a step of:

spraying an abrasion resistant material on a surface of the fluid passages in an area A4 between the circle $C_2$ with the radius $R_2$ and the area A3, by an arc spraying method.

4. The abrasion resistant surface treatment method according to claim 3, further comprising a step of:

spraying an abrasion resistant material on an outer surface of said side plate, by a high speed flame spraying method.

5. A runner comprising:

a main plate and a side plate which are axially spaced and radially extend;

a plurality of vanes which are circumferentially spaced between said main plate and said side plate, and integral with said main plate and said side plate;

said main plate, said side plate, and said vanes defining fluid passages;

an abrasion resistant material being deposited on surfaces of said main plate, said side plate and said vanes which define said fluid passages, by a high speed flame spraying, in an area A1 between an outer periphery of said runner and a circle at a desired distance radially inward from said outer periphery; and an abrasion resistant material including WC, Ni, Cr, Co and B being deposited on the surfaces of said main plate, said side plate and said vanes, by a spraying and fusing method, in an area A3 of the fluid passages of said runner, said area A3 being inside a radially inward opening defined by a circle with a desired radius around an axis of said runner.

6. The runner according to claim 5, wherein an abrasion resistant material including WC, Ni. Cr, Co and B is deposited on the surfaces of said main plate, said side plate and said vanes, by a spraying and fusing method, in an area A2 between a circle $C_1$ with a desired radius $R_1$ and a circle $C_2$ with a desired radius $R_2$.

7. The runner according to claim 6, wherein an abrasion resistant material is deposited on the surfaces of said main plate, said side plate and said vanes, by an arc spraying method, in an area A4 between the circle $C_2$ with the radius $R_2$ and the area A3.

8. The runner according to claim 7, wherein an abrasion resistant material is deposited on an outer surface of said side plate by a high speed flame spraying method.

9. A fluid machine comprising a runner according to any one of claims 5 to 8.

* * * * *